US010030375B2

(12) United States Patent
Shin

(10) Patent No.: US 10,030,375 B2
(45) Date of Patent: Jul. 24, 2018

(54) WASHER FOR AUTOMATICALLY WASHING TOILET WITHOUT POWER

(71) Applicant: Dong Hwa Shin, Seoul (KR)

(72) Inventor: Dong Hwa Shin, Seoul (KR)

( * ) Notice: Subject to any disclaimer, the term of this patent is extended or adjusted under 35 U.S.C. 154(b) by 148 days.

(21) Appl. No.: 14/905,336

(22) PCT Filed: Jul. 21, 2014

(86) PCT No.: PCT/KR2014/006588
§ 371 (c)(1),
(2) Date: Jan. 15, 2016

(87) PCT Pub. No.: WO2015/012543
PCT Pub. Date: Jan. 29, 2015

(65) Prior Publication Data

US 2016/0160486 A1 Jun. 9, 2016

(30) Foreign Application Priority Data

Jul. 25, 2013 (KR) ..... 10-2013-0088225

(51) Int. Cl.
*E03D 5/04* (2006.01)

(52) U.S. Cl.
CPC ..... *E03D 5/04* (2013.01)

(58) Field of Classification Search
CPC .... E03D 5/02; E03D 5/22; E03D 5/04; E03D 5/094

(Continued)

(56) References Cited

U.S. PATENT DOCUMENTS 1,135,028 A * 4/1915 Kreter ..... E03D 5/04 4/408
1,200,529 A * 10/1916 Salzman ..... E03D 5/04 4/408

(Continued)

FOREIGN PATENT DOCUMENTS

KR 20-0185416 Y1 6/2000
KR 10-2006-0049402 A 5/2006

(Continued)

OTHER PUBLICATIONS

KR20060049402—English Translation, machine generated, Aug. 2017.*

*Primary Examiner* — Benjamin R Shaw
(74) *Attorney, Agent, or Firm* — Novick, Kim & Lee, PLLC; Jae Youn Kim

(57) ABSTRACT

The present invention relates to a washer for automatically washing a toilet without power. The washer comprising: a toilet body (10) having a hole (11) formed on an upper end thereof; a washing valve (20) mounted to the upper end of the toilet body (10), the washing valve selectively supplying water to an inside of the toilet body; and a non-powered water supply unit (30) provided on the upper end of the toilet body (10). The present invention is to enable the toilet to be easily washed if a non-powered automatic washer of the present invention is simply mounted to the toilet while using a conventional toilet washing valve as it is. Accordingly, it significantly improves quality and reliability of the conventional automatic toilet washer. Therefore, the washer of the present invention can satisfy a variety of demands (needs) of consumers and give a good impression to the consumers.

6 Claims, 12 Drawing Sheets

(58) Field of Classification Search
USPC ..... 4/408, 412, 413
See application file for complete search history.

(56) References Cited

U.S. PATENT DOCUMENTS 1,564,122 A * 12/1925 Campbell ..... E03D 5/04 4/408
1,603,749 A * 10/1926 Delorme ..... E03D 5/04 4/408
1,676,550 A * 7/1928 Hanamann ..... E03D 5/04 4/408
1,695,621 A * 12/1928 Vogel ..... E03D 5/04 137/625.5
2,116,258 A * 5/1938 Barnard, Jr. ..... E03D 5/026 137/625.5
2,628,363 A * 2/1953 Stein ..... E03D 5/04 4/395
2,679,651 A * 6/1954 Pokorny ..... E03D 5/08 4/249
3,056,142 A * 10/1962 Chin ..... E03D 5/04 4/250
3,780,384 A * 12/1973 Rivelle ..... E03D 1/36 137/625.69
4,329,745 A * 5/1982 Aguero ..... E03D 5/04 200/509
4,338,690 A * 7/1982 Hsieh ..... A47K 13/10 4/246.1
5,410,766 A * 5/1995 Schumacher ..... E03D 5/04 4/250
5,836,021 A * 11/1998 Davidson ..... E03D 5/09 4/411
2009/0193569 A1* 8/2009 Leibfried ..... A47K 13/26 4/236

FOREIGN PATENT DOCUMENTS

KR 10-0804510 B1 2/2008
KR 10-0811461 B1 3/2008
KR 10-2010-0013155 A 2/2010
KR 10-1134147 B1 4/2012

* cited by examiner

WASHER FOR AUTOMATICALLY WASHING TOILET WITHOUT POWER

TECHNICAL FIELD

The present invention relates to a washer for automatically washing a toilet without power. More particularly, the present invention relates to a washer for automatically washing a toilet without power wherein the washer enables the toilet to be easily washed if the automatic non-powered washer of the present invention is simply mounted to the toilet without modification of the conventional toilet washing valve. Accordingly, since the washer of the present invention operates automatically and powerlessly, it significantly improves the quality and reliability of a conventional toilet. Thus the washer can satisfy a variety of demands (needs) of consumers and give a good impression to the consumers.

BACKGROUND ART

In general, a toilet refers to a western-type sanitation fixture used for the disposal of human urine and feces while sitting on a toilet pedestal.

Meanwhile, in the past, an electrical device was used to automatically flush a toilet. The automatic flushing was performed by the operation of an automatic flushing system using power supplied from electricity or a battery.

However, since the conventional toilet mentioned above operates only when there is power, there is spatial limitation in installation and use of the toilet. Further, the toilet also has disadvantages in that it is expensive and difficult to manage, and thus it is impossible to commercialize the toilet.

In addition, the conventional toilet is an electronic product using an infrared sensor, and thus may malfunction due to temperature and humidity. Furthermore, when a battery becomes discharged, the automatic flushing system does not operate, which gives displeasure to a next user of the toilet.

Additionally, though the automatic flushing system sensing a weight on a toilet seat was developed in the related art, the conventional toilet has had problems in that it is required to remove an existing toilet seat and to buy an expensive toilet seat. Furthermore, the conventional toilet has low durability due to configuration of electronic elements, and frequently malfunctions due to humidity and vibration, and thereby it is impossible to use the conventional toilet for a long period.

In addition, as for the conventional toilet equipped with the automatic flushing system, when a toilet cover is lifted, the toilet cover prevents the sensor from operating.

RELATED ART DOCUMENT (Patent Document 1) Korean Patent No. 10-0804510 (Korean Patent Application No. 10-2007-0093047) (Title: APPARATUS FOR POURING WATER IN AN URINAL)

(Patent Document 2) Korean Patent Application Publication No. 10-2010-0013155 (Korean Patent Application No. 10-2008-0074698) (Title: NO-POWER AUTOMATIC FLUSHING SYSTEM OF A TOILET BOWL AND A METHOD WHICH WASHES DEFECATION AND URINATION)

DISCLOSURE

Technical Problem

Accordingly, the present invention has been made keeping in mind the above problems occurring in the related art, and an object of the present invention is to propose a washer for automatically washing a toilet without power, the washer including: a toilet body having a hole formed on an upper end thereof; a washing valve; a non-powered water supply unit; and a press plate, wherein an extension member is provided at an end of the press plate such that the extension member is formed integrally with a toilet seat. A second object of the present invention is to increase workability and reduce cost by providing a washer with a simple configuration. A third object of the present invention is to propose a washer for automatically washing a toilet, the washer being an environmentally friendly device that does not require energy and that can realize equivalent performance of a conventional automatic toilet washer. A fourth object of the present invention is to enable the toilet to be easily washed if an automatic non-powered washer of the present invention is simply mounted to the toilet without modification of a conventional toilet washing valve. A fifth object of the present invention is to provide effect of cost reduction since the washer of the present invention enables an existing toilet seat to be kept in use without buying an expensive toilet seat. A sixth object of the present invention is to propose the washer that has high durability and has high resistance to humidity and vibration since the washer is not made up of electronic elements, and thus does not malfunction. A seventh object of the present invention is to propose the washer that does not malfunction despite a long period of use. An eighth object of the present invention is to propose the washer that does not have a conventional art problem wherein the toilet cover blocks the sensor when the toilet cover is lifted, since the washer of the present invention does not use the sensor. Accordingly, since the washer of the present invention automatically and powerlessly washes the toilet, it significantly improves quality and reliability of the conventional automatic toilet washer. Therefore, the washer of the present invention can satisfy a variety of demands (needs) of consumers and give a good impression to the consumers.

Technical Solution

In order to achieve the above object, according to one aspect of the present invention, there is provided a washer for automatically washing a toilet without power, the washer including: a toilet body having a hole 11 formed on an upper end thereof so that a protrusion is fitted into the hole; a washing valve 20 mounted to the upper end of the toilet body 10, the washing valve selectively supplying water to an inside of the toilet body; and a non-powered water supply unit 30 provided on the upper end of the toilet body 10, wherein when a user uses the toilet, a toilet seat 15 is lowered by the user's weight and is raised after the user finishes using the toilet, and the non-powered water supply unit automatically supplies water to the inside of the toilet body.

Advantageous Effects

According to the present invention having the above-described characteristics, it is possible to propose a washer for automatically washing a toilet without power including: a toilet body having a hole formed on an upper end thereof; a washing valve; a non-powered water supply unit; and a press plate, wherein an extension member is provided at an end of the press plate such that the extension member is formed integrally with a toilet seat.

The present invention having above-mentioned configuration can increase workability and reduce cost due to a simple configuration.

Particularly, since the washer of the present invention operates automatically and powerlessly, it is an environmentally friendly device that does not require energy and can realize equivalent performance of a conventional automatic toilet washer.

Additionally, the present invention enables the toilet to be easily washed if a non-powered automatic washer of the present invention is simply mounted to the toilet without modification of a conventional toilet washing valve.

In addition, the present invention reduces cost since the washer of the present invention enables an existing toilet seat to be kept in use without buying an expensive toilet seat.

Furthermore, the present invention proposes a washer that has high durability and has high resistance to humidity and vibration since the washer is not made up of electronic elements, and thus does not malfunction.

Accordingly, the present invention proposes a washer that does not malfunction despite a long period of use.

The present invention proposes the washer that does not have a conventional art problem wherein a toilet cover blocks the sensor when the toilet cover is lifted, since the washer of the present invention does not use a sensor.

Accordingly, since the automatic and non-powered toilet washer of the present invention significantly improves quality and reliability of the conventional automatic toilet washer, the washer of the present invention can satisfy a variety of demands (needs) of consumers and thereby give a good impression to the consumers.

In order to achieve the above effects, exemplary embodiments will be described in detail below referring to the accompanying drawings.

DESCRIPTION OF THE REFERENCE NUMERALS IN THE DRAWINGS

Figure 1:
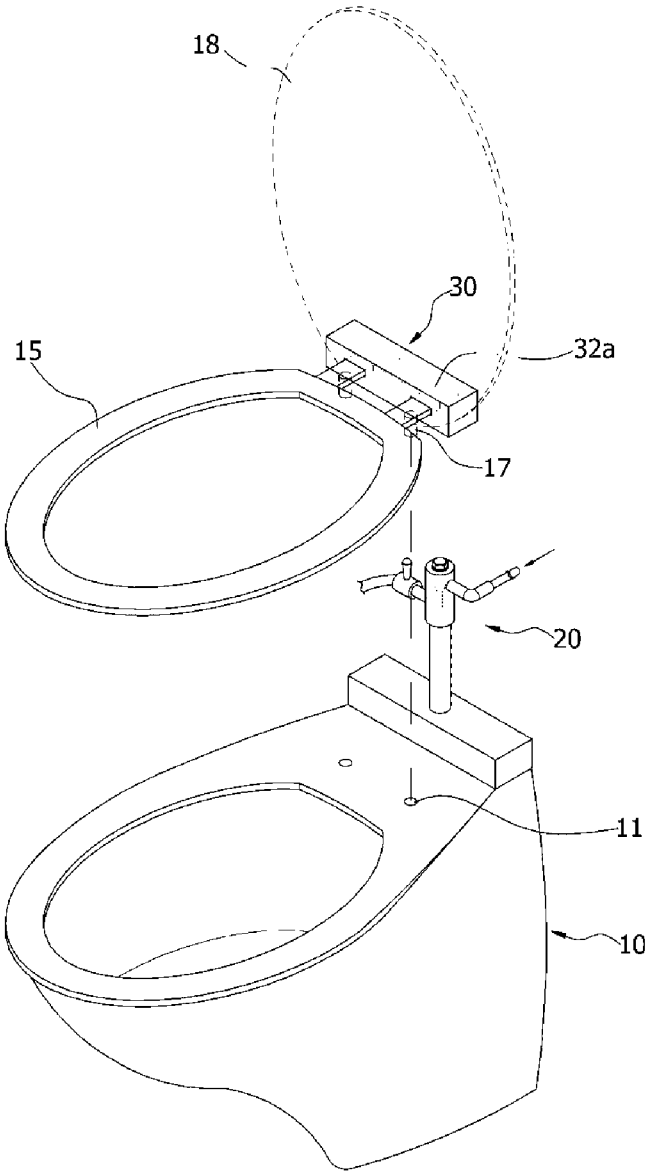
FIG. 1 is an exploded perspective view of a washer for automatically washing a toilet without power according to a first embodiment of the present invention.

10: Toilet body
20: Washing valve
30: Non-powered water supply unit
50: Drain valve

Best Mode

A washer for automatically washing a toilet without power according to embodiments of the present invention is configured as shown in FIGS. 1 to 11.

In the following description, when well-known functions or specific descriptions of the configuration are determined to unnecessarily obscure the subject matter of the present invention, a detailed description thereof will be omitted.

Additionally, terms to be described hereinafter are set in consideration of functions of the present invention, and since the terms may vary according to the intention or practice of a producer, definition of the terms should be made according to details throughout the present specification.

First, according to a first embodiment of the present invention, the washer for automatically washing the toilet without power is provided with a toilet body 10 having a hole 11 formed on an upper end thereof so that a protrusion is fitted into the hole;

In addition, the washer of the present invention is provided with a washing valve 20 mounted to the upper end of the toilet body 10, the washing valve selectively supplying water to an inside of the toilet body;

Furthermore, the washer of the present invention is provided with a non-powered water supply unit 30 provided on the upper end of the toilet body 10, wherein when a user uses the toilet, a toilet seat 15 is lowered by the user's weight and is raised after the user finishes using the toilet, and the non-powered water supply unit automatically supplies water to the inside of the toilet body.

The present invention mentioned above will be described more in detail below.

Figure 2:
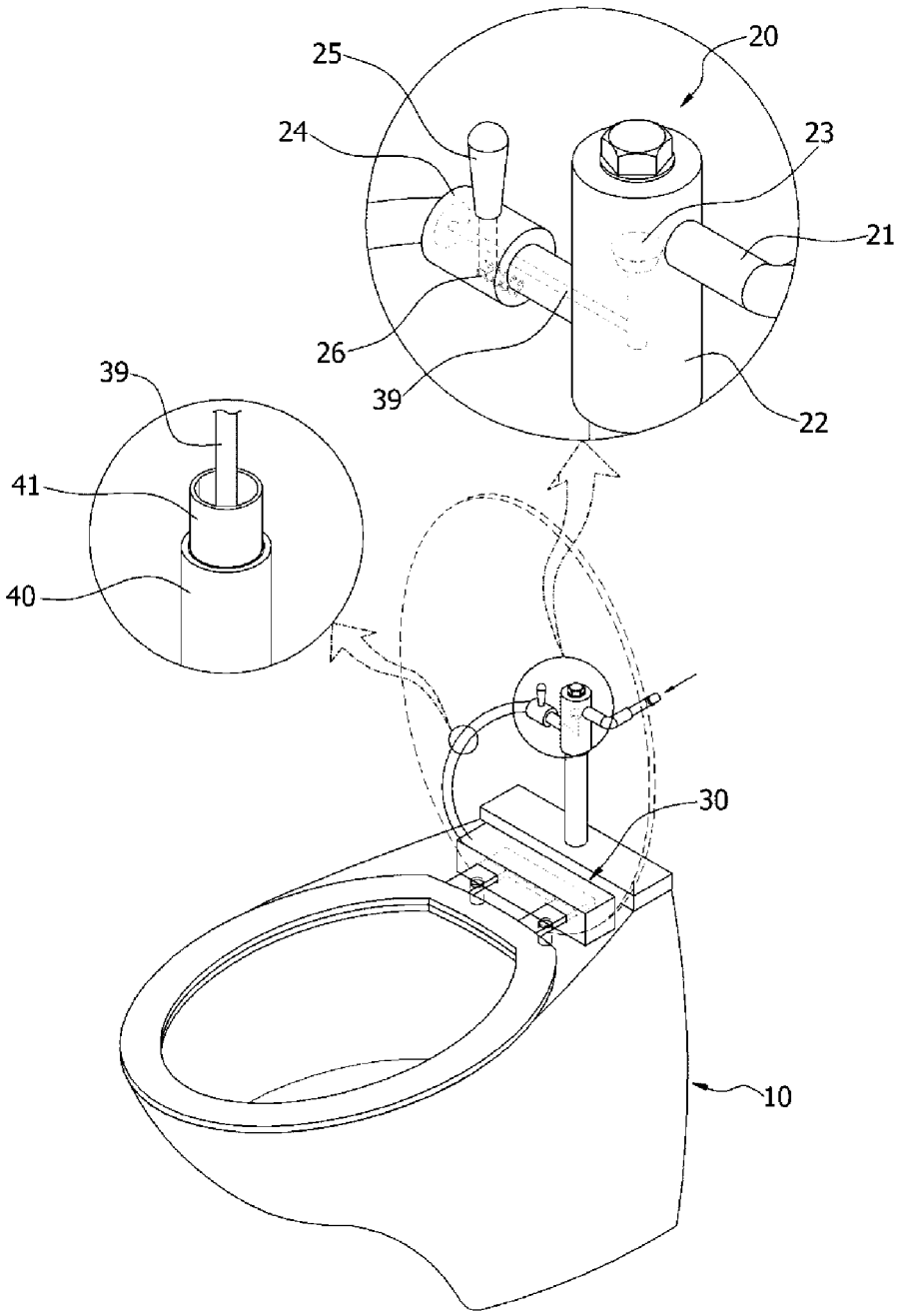
FIG. 2 is a perspective view showing a combined state of the washer for automatically washing the toilet without power according to the first embodiment of the present invention.
Figure 3:
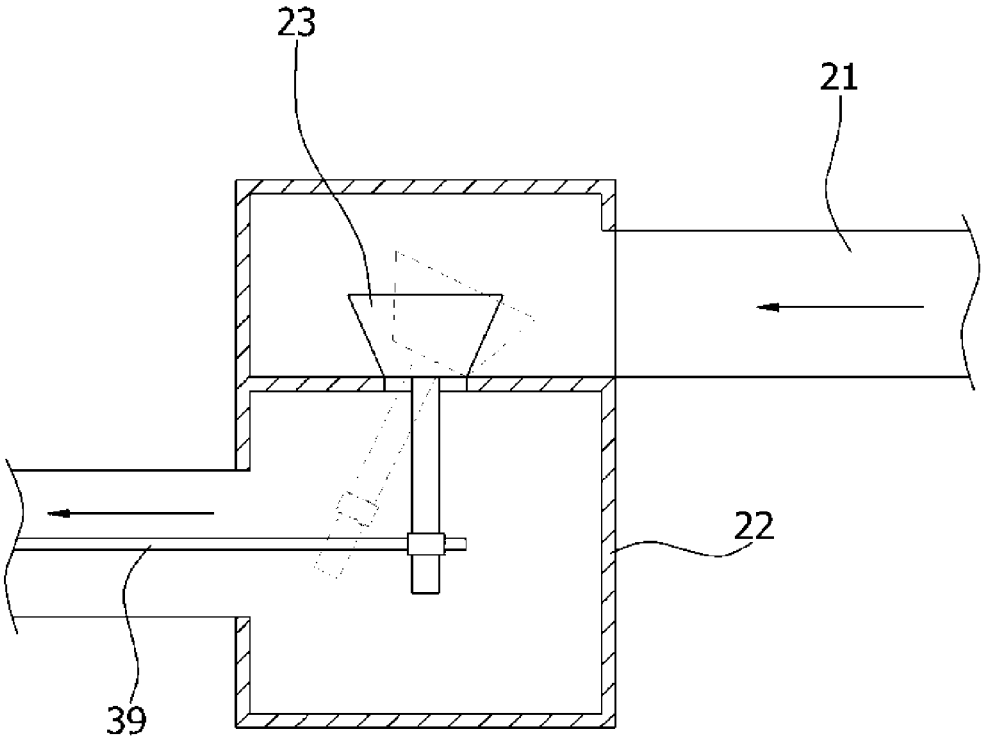
FIG. 3 is a cross-sectional view of a main part of a washing valve body according to the first embodiment of the present invention.
Figure 4:
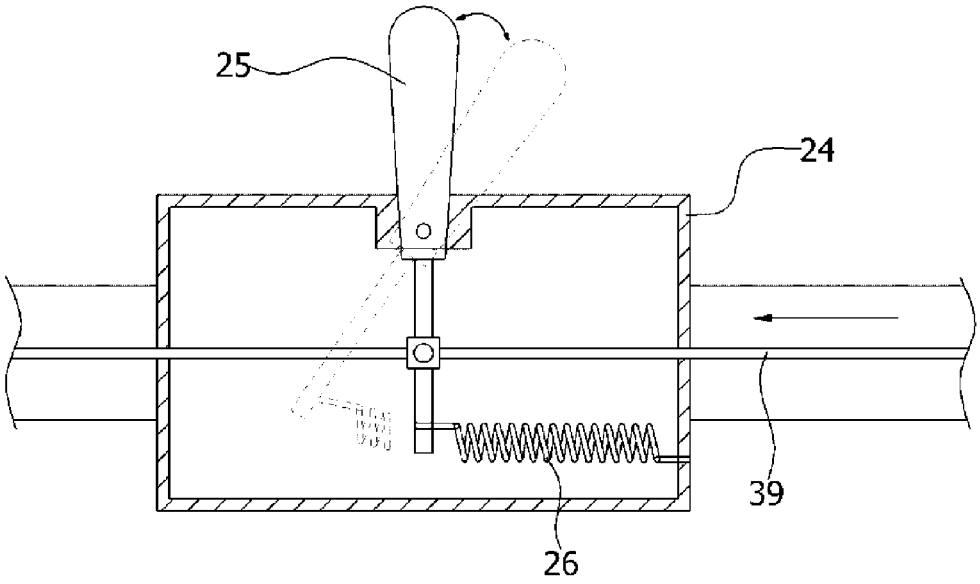
FIG. 4 is a cross-sectional view of a main part of a washing valve provided with a handle according to the first embodiment of the present invention.

As shown in FIGS. 2 to 4, the washing valve 20 includes a washing valve body 22 provided with a valve 23 therein, and a wire 39 connected to a lower part of the valve.

In this case, a water supply tube 21 is provided on a first side of the washing valve body 22 for supplying water.

In addition, a wire protection tube 40 is provided on a second side of the washing valve body 22, the wire protection tube being connected to the non-powered water supply unit 30, and wherein the wire protection tube 40 includes: the wire 39 provided in the wire protection tube; and a protective tube 41 provided outside the wire therein so as to protect the wire.

Furthermore, according to the first embodiment of the present invention, a handle 25 is mounted to an extension tube 24 provided on the second side of the washing valve body 22 so as to manually operate the non-powered water supply unit 30, with a spring 26 being provided in the extension tube 24 and connected to the handle 25.

Figure 11A:
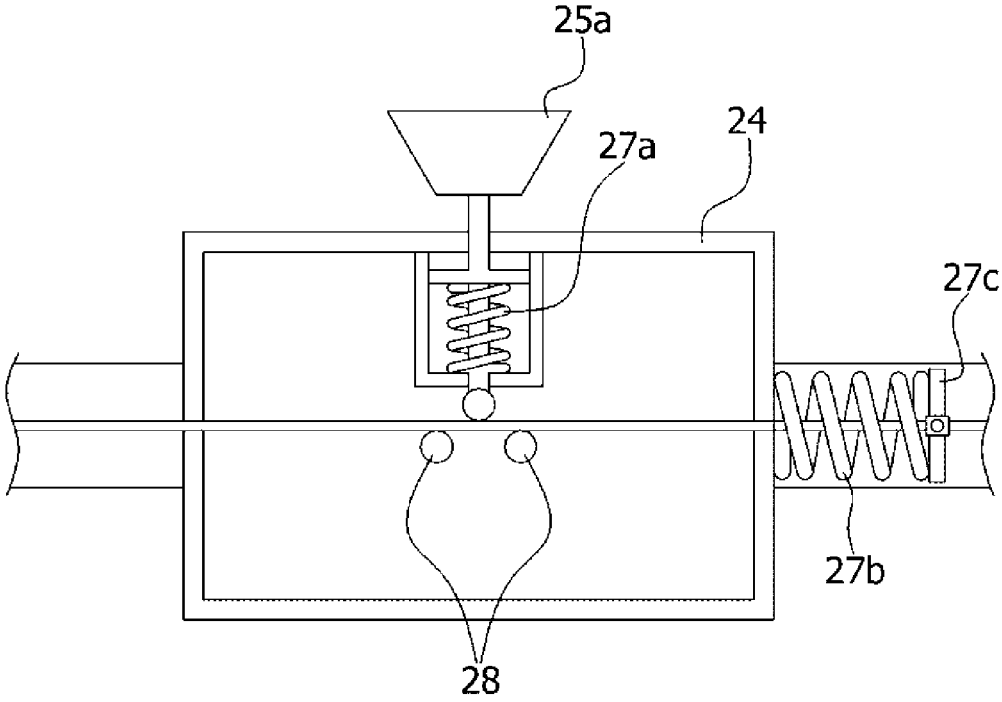
FIGS. 11*a* and 11*b* are cross-sectional views showing the operation state of a main part of a washing valve according to the second embodiment of the present invention.
Figure 11B:
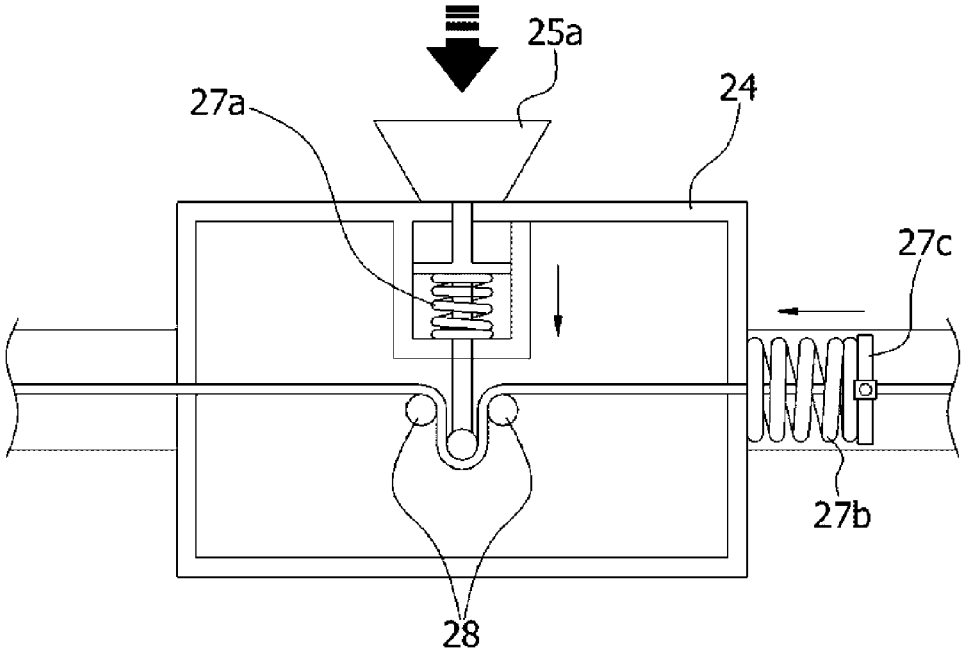

Aside from the above-mentioned configuration, according to a second embodiment of the present invention, as shown in FIGS. 11*a* and 11*b*, a manual button 25*a* is mounted to the extension tube 24 provided on the second side of a washing valve body 22 so as to manually operate a non-powered water supply unit 30, with a spring 27*a* being provided in the extension tube, wherein a plurality of rollers 28 are provided in the extension tube so as to adjust tension of a wire 39 while the wire is loosened or tightened. Additionally, a washer 27*c* and a spring 27*b* may be provided by being combined with each other at a location outside the extension tube such that the washer and the spring restore the tightened wire.

Figure 10:
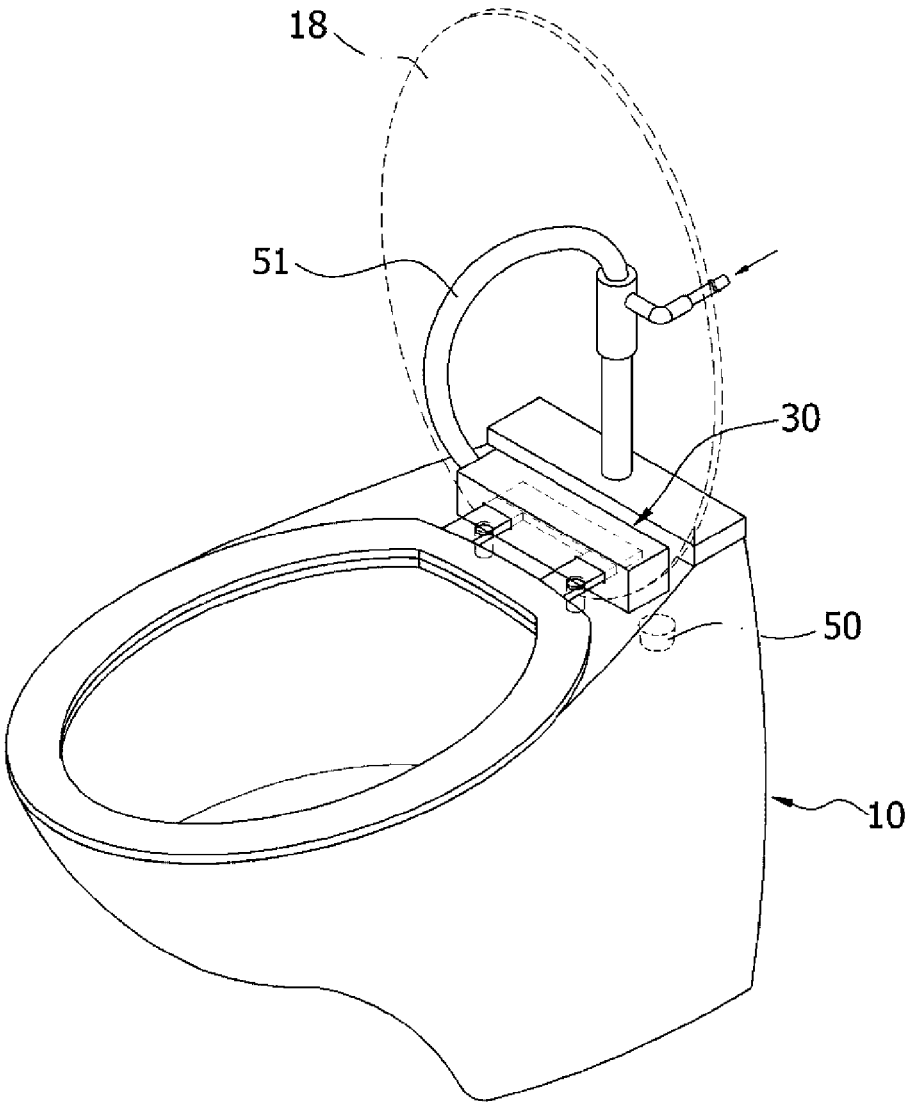
FIG. 10 is a perspective view of a washer for automatically washing a toilet without power according to a second embodiment of the present invention.

In addition, aside from the above-mentioned configuration, according to the second embodiment of the present invention, as shown in FIG. 10, a drain valve 50 is provided in a toilet body 10, the drain valve being connected to the wire 39, and a pipe 51 is provided by being connected between the washing valve body 22 and the non-powered water supply unit 30, the pipe 51 supplying water to the inside of the toilet body 10 using hydraulic pressure.

Figure 7:
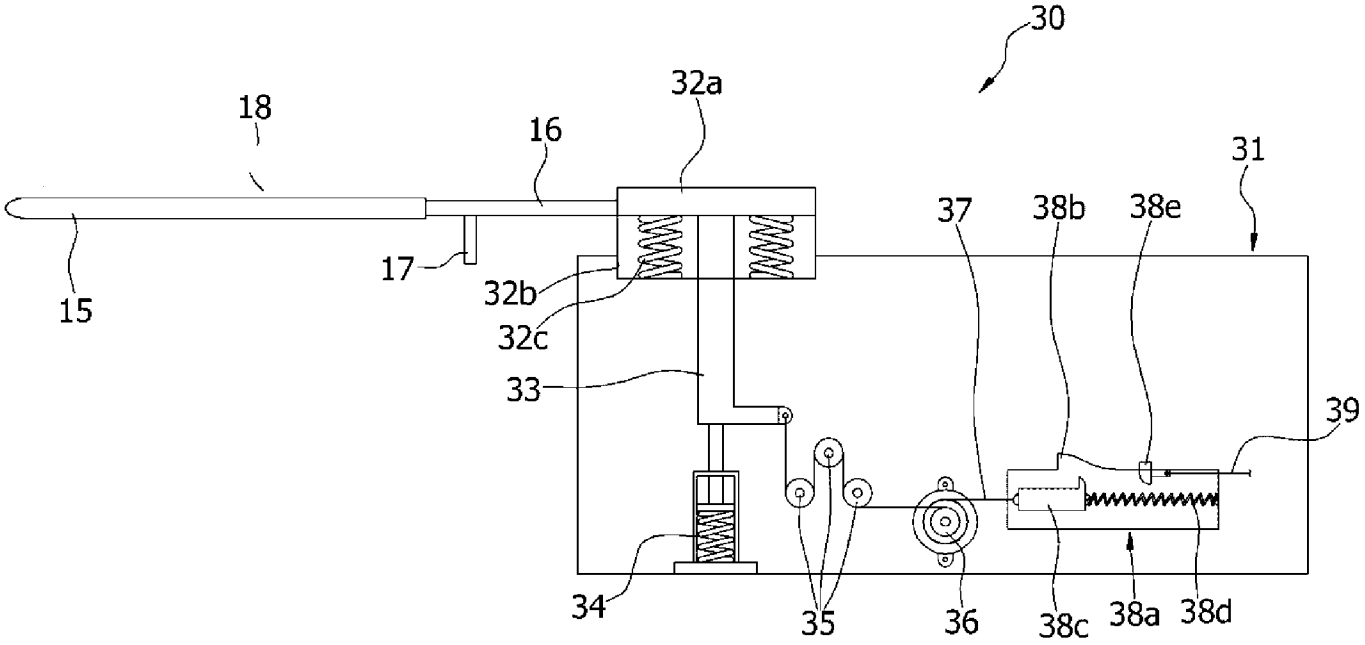
FIG. 7 is a state view of a spring extended by a cable of a non-powered water supply unit being pulled according to the first embodiment of the present invention.
Figure 8:
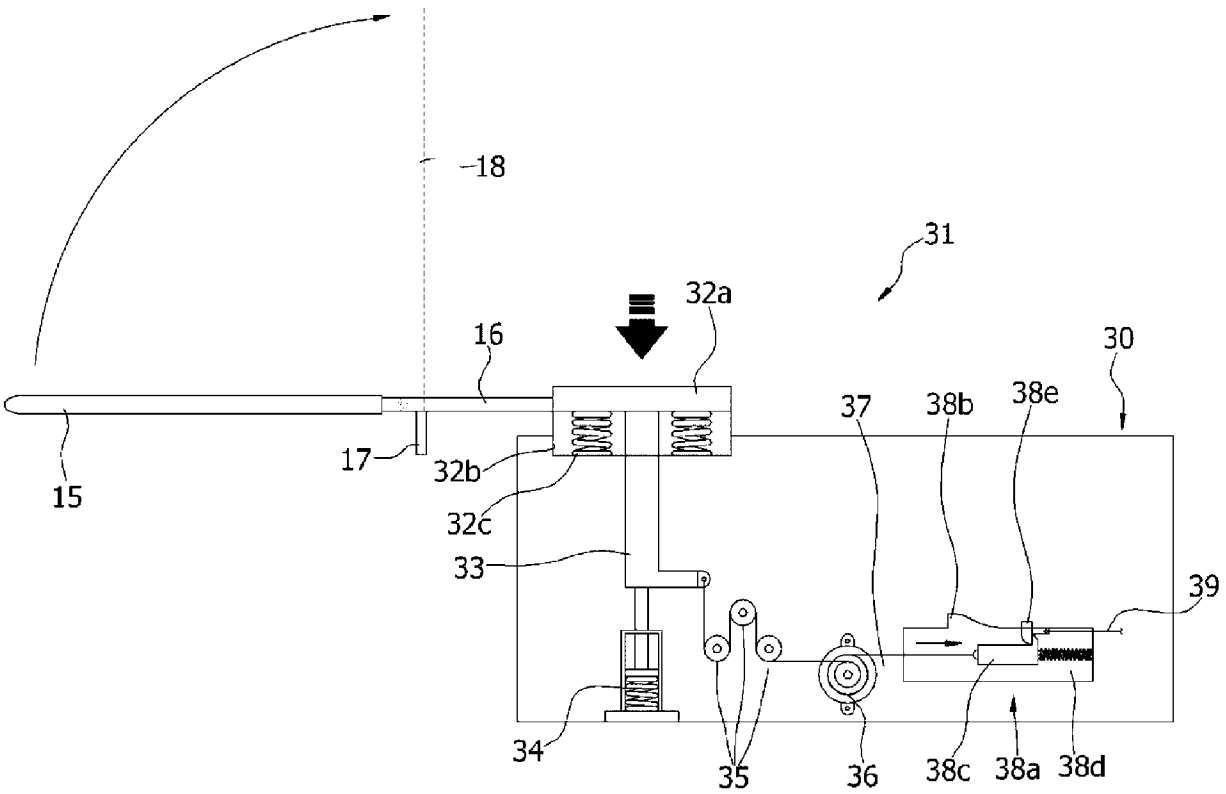
FIG. 8 is a state view of an operation protrusion locked to a locking protrusion when the spring is restored to an original state after the cable of the non-powered water supply unit is loosened according to the first embodiment of the present invention.
Figure 9:
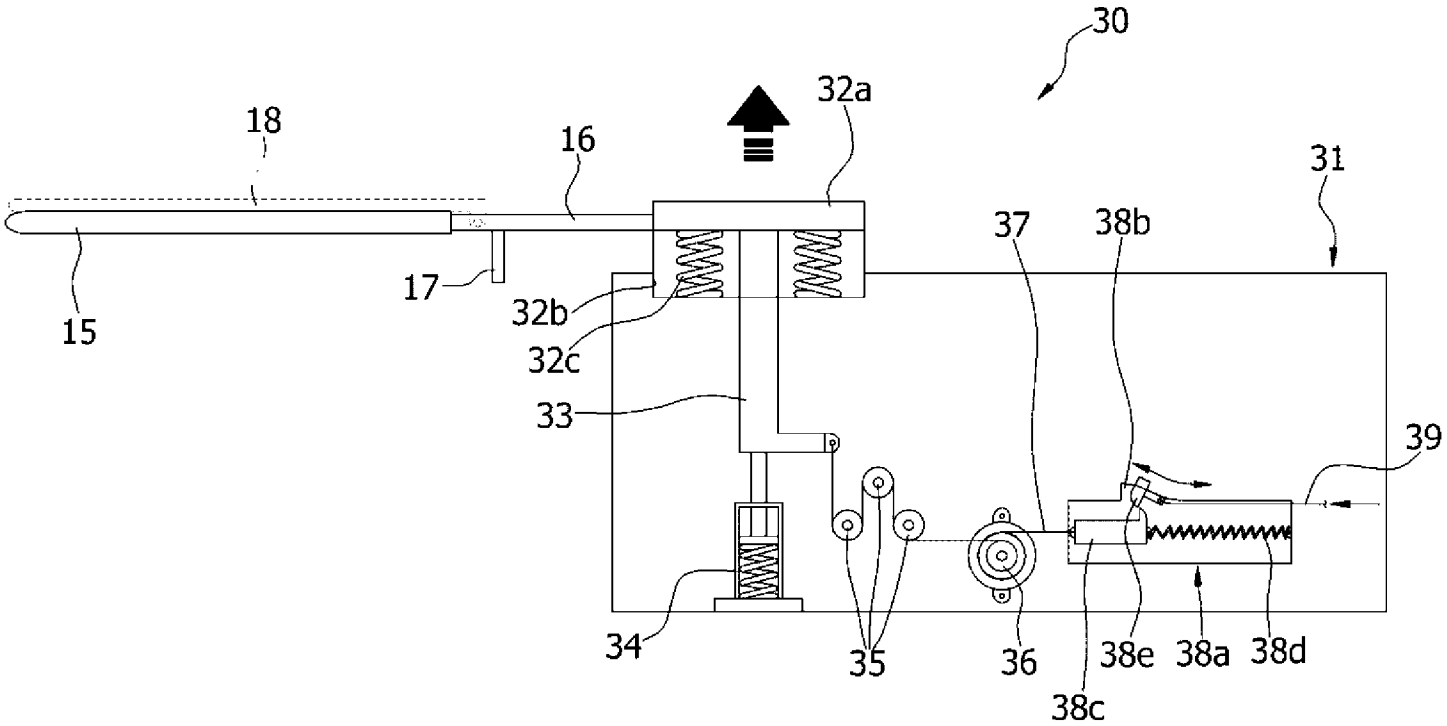
FIG. 9 is a state view of a wire pulled when the operation protrusion of the non-powered water supply unit pulls the locking protrusion according to the first embodiment of the present invention.

Meanwhile, the non-powered water supply unit 30 is configured as shown in FIGS. 7 to 9.

That is, a press plate 32*a* is provided by being protruded from an upper end of a non-powered water supply body 31, wherein an extension member 16 is provided at an end of the press plate such that the extension member is formed integrally with the toilet seat 15.

In addition, a cable adjustment member 33 is provided by being protruded from a lower end of the press plate 32*a*, with a cable 37 being connected to the cable adjustment member.

Furthermore, a spring 32*c* is provided around an outer circumferential surface of the cable adjustment member 33 in a spring chamber 32*b*, the spring 32*c* being compressed from and restored to original state thereof.

Additionally, a protrusion body 38*a* is provided in the non-powered water supply body 31, wherein the cable 37 is connected to a first end of an operation protrusion 38*c* in the protrusion body and a spring 38*d* is connected to a second end of the operation protrusion.

In addition, a locking protrusion 38*e* is provided in the protrusion body 38*a*, the wire 39 is connected to an end of the locking protrusion, and a hill part 38*b* is provided on an upper end of the protrusion body such that the locking protrusion 38*e* is lowered while the locking protrusion is released from the operation protrusion 38*c* after the locking protrusion is raised by the operation protrusion.

Figure 5:
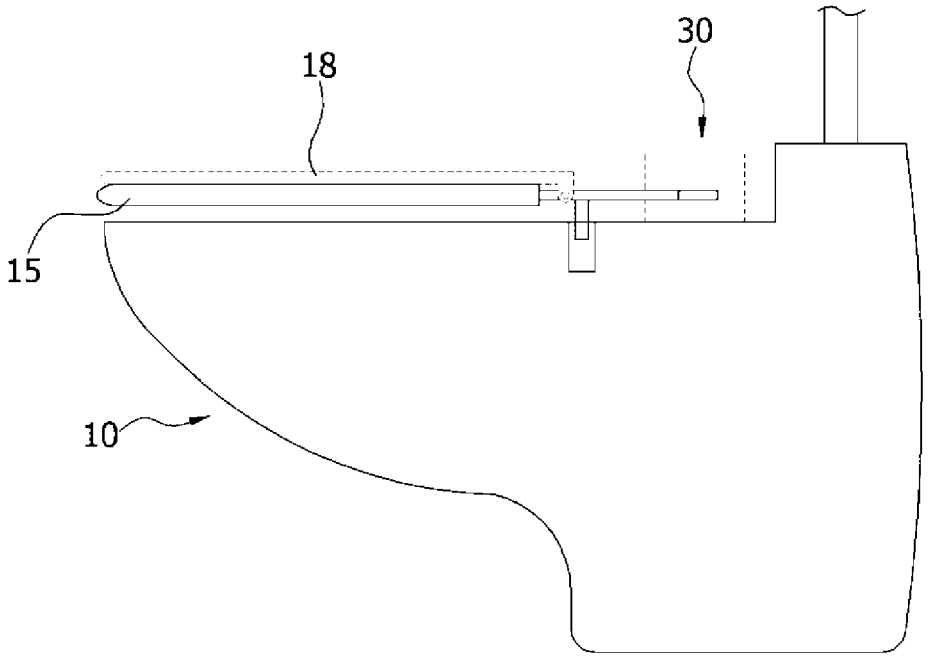
FIG. 5 is a view showing a state of the toilet prior to using the washer for automatically washing the toilet without power according to the first embodiment of the present invention.
Figure 6:
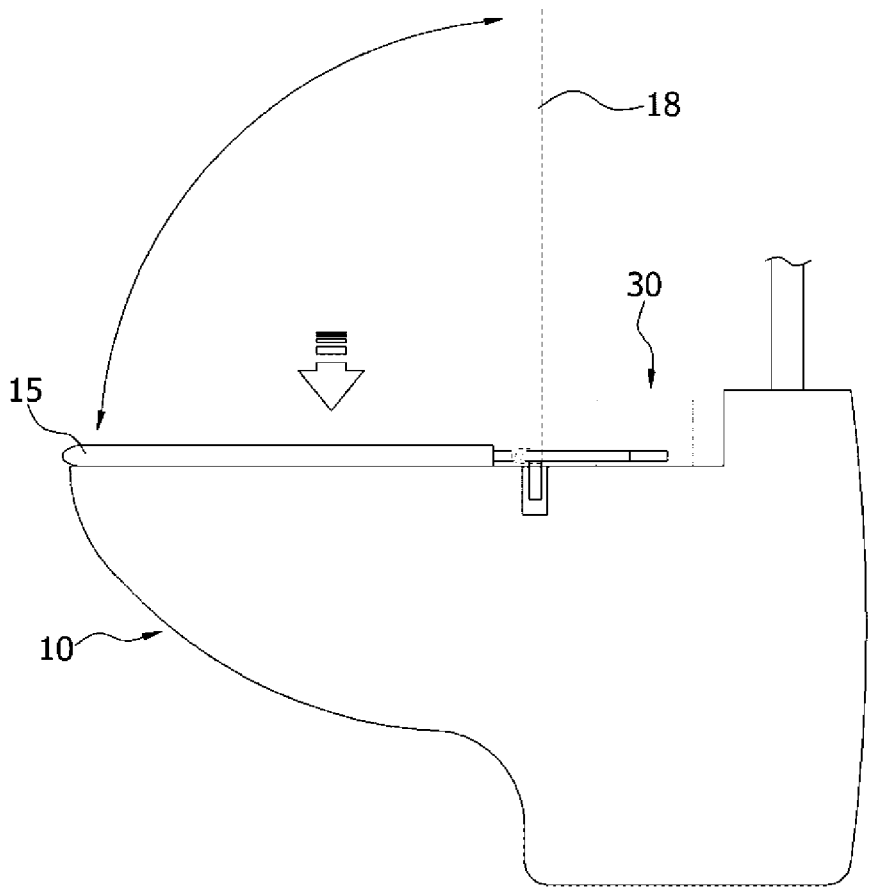
FIG. 6 is a view showing a state of the toilet while using the washer for automatically washing the toilet without power according to the first embodiment of the present invention.

Furthermore, according to the first embodiment of the present invention, as shown in FIGS. 5 and 6, at least one protrusion 17 is provided on a lower end of the extension member 16, the protrusion 17 being fitted into the hole 11 of the toilet body 10.

Additionally, according to the first embodiment of the present invention, a cylinder 34 is provided under the cable adjustment member 33 such that the cylinder increases a restoring force of the press plate 32*a*.

In addition, according to the first embodiment of the present invention, a plurality of rollers 35 are provided in the non-powered water supply body 31 so as to adjust tension of the cable 37, and a rotating member 36 is provided at a side of the rollers such that the rotating member adjusts a length of the cable while the cable is slowly loosened after being tightened.

Meanwhile, the above-mentioned elements of the present invention may be variously modified and take a variety of shapes.

Additionally, although the preferred embodiments of the present invention have been disclosed for illustrative purposes, those skilled in the art will appreciate that various modifications, additions and substitutions are possible, without departing from the scope and spirit of the invention as disclosed in the accompanying claims.

The washer for automatically washing a toilet without power according to the present invention having the above-mentioned configuration has an operational effect as described below.

First of all, the washer of the present invention having above-mentioned configuration enables the toilet to be easily washed when the non-powered automatic washer of the present invention is simply mounted to the toilet using an unmodified conventional toilet washing valve. Furthermore, the washer for automatically washing a toilet without power is an environmentally friendly device that does not require energy, and can realize equivalent performance of a conventional automatic toilet washer.

To achieve the above-mentioned object, according to the first embodiment of the present invention, as shown in FIG. 1, the non-powered water supply unit 30 is provided on the upper end of the toilet body 10, and in this case, the protrusion 17 is fitted into the hole 11, and the wire protection tube 40 of the non-powered water supply unit 30 is provided by being connected to the extension tube 24.

Before the toilet of the present invention having the above-mentioned configuration is used, as shown in FIG. 5, the toilet seat 15 remains lifted from the upper end of the toilet body 10. In this case, as shown in FIG. 7, while the cable 37 of the non-powered water supply unit 30 is tightened, the operation protrusion 38*c* is located at a left side of the protrusion body 38*a*, and the spring 38*d* remains extended.

In this case, as shown in FIG. 6, when the user lifts a toilet cover 18 to use the toilet, and then sits on the toilet seat 15, the toilet seat 15 is lowered by the user's weight. In this case, the protrusion 17 is fitted into the hole 11 while being lowered, and the extension member 16 and the press plate 32*a* are also lowered together with the protrusion 17.

In addition, the spring 32*c* provided in the spring chamber 32*b* is compressed by the press plate 32*a* being lowered, and the cable adjustment member 33 is lowered. As shown in FIG. 8, when the cylinder 34 is compressed by the cable adjustment member 33 being lowered, the cable 37 is loosened, and the operation protrusion 38*c* is moved to a right side of the protrusion body 38*a* by a restoring force of the spring 38*d*, and the operation protrusion 38*c* is locked to the locking protrusion 38*e*.

In this case, when the user stands up from the toilet seat 15 after the user finishes using the toilet, the toilet seat 15 is lifted up to an initial position by restoring forces of the cylinder 34 and the spring 32*c*, and in this process, the cable 37 is pulled again to a side of the non-powered water supply body 31 by the press plate 32*a* and the cable adjustment member 33 being lifted. As shown in FIG. 9, as the cable 37 is pulled, the operation protrusion 38*c* is moved again to the left side of the protrusion body 38*a* and moves the locking protrusion 38*e* to a side of the protrusion body 38*a*. Further, when the locking protrusion 38*e* reaches the hill part 38*b* after the locking protrusion 38*e* is moved to the side, the locking protrusion 38*e* is removed from the operation protrusion 38*c*, and the wire 39 pulled to the side by the locking protrusion 38*e* that is moved to the side operates the washing valve 20, and thus water is supplied to the inside of the toilet body 10.

The rollers 35 adjust tension of the cable 37 while the cable 37 is tightened or loosened, and with a silicon provided in a body (not shown) of the rotating member 36, a rotation blade of the rotating member 36 tightens or loosens the cable by performing a normal rotation and a reverse rotation.

Meanwhile, operation of the washing valve 20 will be described below.

When the wire 39 is pulled by the locking protrusion 38*e* moved to the side as mentioned above, the wire 39 passing though the wire protection tube 40, the extension tube 24, and the washing valve body 22 pulls the valve 23 to a side. Then, as shown in FIG. 3, water supplied through the water supply tube 21 is introduced into the washing valve body 22 through a gap formed while the valve 23 is slanted, and the water is supplied to the inside of the toilet body 10.

On the other hand, the washer of the present invention can supply water to the inside of the toilet body 10 manually, not automatically.

That is, as shown FIG. 4, when a user pulls the handle 25 to a right side after the user finishes using the toilet, the handle 25 rotates relative to a hinge shaft, and in this process, the wire 39 connected to the lower part of the handle 25 is pulled to the left side, and water is supplied to the inside of the toilet body 10. And then the handle 25 is restored to an initial state by a restoring force of the spring 26 connected to the lower part of the handle 25.

According to the first embodiment of the present invention, the washing valve 20 may be operated as mentioned above, and as shown in FIG. 10, water may be supplied to an inside of the toilet body 10 by hydraulic pressure.

That is, when a user stands up after he or she finishes using the toilet with the pipe 51 provided between the washing valve body 22 and the non-powered water supply body 31 filled with water, the wire 39 is pulled. Then, the drain valve 50 provided in the toilet body 10 is opened by the wire 39, and the water is supplied to the inside of the toilet body 10 by the hydraulic pressure, thereby washing the toilet.

In addition, another operational effect of the washer of the present invention is that, as shown in FIGS. 11*a* and 11*b*, water can be manually supplied to the inside of the toilet body 10 by pressing the manual button 25*a*.

That is, FIG. 11*a* shows a state of the wire 39 not pulled to a side, and in this case, a user presses the manual button 25*a* after he or she finishes using the toilet. Then, as shown in FIG. 11*b*, when a lower end of the manual button 25*a* presses the wire 39 while the spring 27*a* is pressed, the wire 39 is lowered, and the wire 39 is pulled to the side, and thus water is supplied to the inside of the toilet. Then, when the user releases the manual button 25*a*, the manual button 25*a* is lifted by a restoring force of the spring 27*a*, and the wire 39 is restored to an original state by the washer 27*c* and the spring 27*b*.

INDUSTRIAL APPLICABILITY

A washer for automatically washing a toilet without power according to a technology of the present invention can achieve the same repeated results, and particularly, embodiments of the present invention can promote technological development in an associated industry and serve to develop the associated industry, and thus it is worthy of protecting the technology of the present invention.

The invention claimed is:

1. A washer for automatically washing a toilet without power, the washer comprising:

a toilet body having a hole formed on an upper end thereof so that a protrusion is fitted into the hole;

a washing valve mounted to the upper end of the toilet body, the washing valve selectively supplying water to an inside of the toilet body; and a non-powered water supply unit provided on the upper end of the toilet body, wherein when a user uses the toilet, a toilet seat is lowered by the user's weight and is raised after the user finishes using the toilet, and the non-powered water supply unit automatically supplies water to the inside of the toilet body, wherein the washing valve comprises:

a washing valve body provided with a valve therein, and a wire connected to a lower part of the valve;

a water supply tube provided on a first side of the washing valve body for supplying water; and a wire protection tube provided on a second side of the washing valve body, the wire protection tube being connected to the non-powered water supply unit, and wherein a handle is mounted to an extension tube provided on the second side of the washing valve body so as to manually operate the non-powered water supply unit, with a spring being provided in the extension tube and connected to the handle, and wherein the non-powered water supply unit comprises:

a press plate provided by being protruded from an upper end of a non-powered water supply body, wherein an extension member is provided at an end of the press plate such that the extension member is formed integrally with the toilet seat;

a cable adjustment member provided by being protruded from a lower end of the press plate, with a cable being connected to the cable adjustment member;

a spring provided around an outer circumferential surface of the cable adjustment member in a spring chamber, the spring being compressed from and restored to original state thereof; and a protrusion body provided in the non-powered water supply body, wherein the cable is connected to a first end of an operation protrusion in the protrusion body and a spring is connected to a second end of the operation protrusion, wherein a locking protrusion is provided in the protrusion body, a wire is connected to an end of the locking protrusion, and a hill part is provided on an upper end of the protrusion body such that the locking protrusion is lowered while the locking protrusion is released from the operation protrusion after the locking protrusion is raised by the operation protrusion.

2. The washer of claim 1, further comprising an inner protective tube disposed to cover the wire disposed therein, wherein the wire protection tube is disposed to cover the inner protective tube.

3. A washer for automatically washing a toilet without power, the washer comprising:

a toilet body having a hole formed on an upper end thereof so that a protrusion is fitted into the hole;

a washing valve mounted to the upper end of the toilet body, the washing valve selectively supplying water to an inside of the toilet body; and a non-powered water supply unit provided on the upper end of the toilet body, wherein when a user uses the toilet, a toilet seat is lowered by the user's weight and is raised after the user finishes using the toilet, and the non-powered water supply unit automatically supplies water to the inside of the toilet body, wherein the non-powered water supply unit comprises:

a press plate provided by being protruded from an upper end of a non-powered water supply body, wherein an extension member is provided at an end of the press plate such that the extension member is formed integrally with the toilet seat;

a cable adjustment member provided by being protruded from a lower end of the press plate, with a cable being connected to the cable adjustment member;

a spring provided around an outer circumferential surface of the cable adjustment member in a spring chamber, the spring being compressed from and restored to original state thereof; and a protrusion body provided in the non-powered water supply body, wherein the cable is connected to a first end of an operation protrusion in the protrusion body and a spring is connected to a second end of the operation protrusion, wherein a locking protrusion is provided in the protrusion body, a wire is connected to an end of the locking protrusion, and a hill part is provided on an upper end of the protrusion body such that the locking protrusion is lowered while the locking protrusion is released from the operation protrusion after the locking protrusion is raised by the operation protrusion, and wherein the washer further comprises at least one protrusion provided on a lower end of the extension member, the protrusion being fitted into the hole of the toilet body.

4. A washer for automatically washing a toilet without power, the washer comprising:

a toilet body having a hole formed on an upper end thereof so that a protrusion is fitted into the hole;

a washing valve mounted to the upper end of the toilet body, the washing valve selectively supplying water to an inside of the toilet body; and a non-powered water supply unit provided on the upper end of the toilet body, wherein when a user uses the toilet, a toilet seat is lowered by the user's weight and is raised after the user finishes using the toilet, and the non-powered water supply unit automatically supplies water to the inside of the toilet body, wherein the non-powered water supply unit comprises:

a press plate provided by being protruded from an upper end of a non-powered water supply body, wherein an extension member is provided at an end of the press plate such that the extension member is formed integrally with the toilet seat;

a cable adjustment member provided by being protruded from a lower end of the press plate, with a cable being connected to the cable adjustment member;

a spring provided around an outer circumferential surface of the cable adjustment member in a spring chamber, the spring being compressed from and restored to original state thereof; and a protrusion body provided in the non-powered water supply body, wherein the cable is connected to a first end of an operation protrusion in the protrusion body and a spring is connected to a second end of the operation protrusion, wherein a locking protrusion is provided in the protrusion body, a wire is connected to an end of the locking protrusion, and a hill part is provided on an upper end of the protrusion body such that the locking protrusion is lowered while the locking protrusion is released from the operation protrusion after the locking protrusion is raised by the operation protrusion, and wherein the washer further comprises a cylinder provided under the cable adjustment member such that the cylinder increases a restoring force of the press plate.

5. The washer of claim 1, wherein a plurality of rollers are provided in the non-powered water supply body so as to adjust tension of the cable, and a rotating member is provided at a side of the rollers such that the rotating member adjusts a length of the cable while the cable is slowly loosened after being tightened.

6. The washer of claim 1, wherein a manual button is mounted to an extension tube provided on the second side of the washing valve body so as to manually operate the non-powered water supply unit, with a spring being provided in the extension tube, wherein a plurality of rollers are provided in the extension tube so as to adjust tension of the wire while the wire is loosened or tightened, and a washer and a spring are provided by being combined with each other at a location outside the extension tube such that the washer and the spring restore the tightened wire.

* * * * *